US009638213B2

(12) United States Patent
Obrecht et al.

(10) Patent No.: US 9,638,213 B2
(45) Date of Patent: May 2, 2017

(54) COMPRESSOR CASING COMPRISING CAVITIES HAVING AN OPTIMISED UPSTREAM SHAPE

(71) Applicant: SNECMA, Paris (FR)

(72) Inventors: Thierry Jean-Jacques Obrecht, Melun (FR); Olivier Stephane Domercq, Brie Comte Robert (FR)

(73) Assignee: SNECMA, Paris (FR)

( * ) Notice: Subject to any disclaimer, the term of this patent is extended or adjusted under 35 U.S.C. 154(b) by 340 days.

(21) Appl. No.: 14/391,080

(22) PCT Filed: Apr. 15, 2013

(86) PCT No.: PCT/FR2013/050829

§ 371 (c)(1),
(2) Date: Oct. 7, 2014

(87) PCT Pub. No.: WO2013/156726

PCT Pub. Date: Oct. 24, 2013

(65) Prior Publication Data

US 2015/0078889 A1 Mar. 19, 2015

(30) Foreign Application Priority Data

Apr. 19, 2012 (FR) ..... 12 01160

(51) Int. Cl.
*F04D 29/54* (2006.01)
*F04D 27/02* (2006.01)
(Continued)

(52) U.S. Cl.
CPC ..... *F04D 29/547* (2013.01); *F04D 17/10* (2013.01); *F04D 19/00* (2013.01);
(Continued)

(58) Field of Classification Search
CPC .... F04D 29/547; F04D 29/4206; F04D 19/00; F04D 17/10; F04D 29/526; F04D 29/164;
(Continued)

(56) References Cited

U.S. PATENT DOCUMENTS 6,736,594 B2 * 5/2004 Irie ..... F01D 11/08 415/128
7,210,905 B2 * 5/2007 Lapworth ..... F04D 29/526 415/220
(Continued)

FOREIGN PATENT DOCUMENTS

EP 1 191 231 A2 3/2002
EP 2 025 945 A2 2/2009
(Continued)

OTHER PUBLICATIONS

U.S. Appl. No. 14/390,178, filed Oct. 2, 2014, Obrecht, et al.
International Search Report issued Oct. 14, 2013 in PCT/FR2013/050829 filed Apr. 15, 2013.

*Primary Examiner* — John K Fristoe, Jr.
*Assistant Examiner* — Eldon Brockman
(74) *Attorney, Agent, or Firm* — Oblon, McClelland, Maier & Neustadt, L.L.P.

(57) ABSTRACT

A casing for a turbine engine compressor, including: cavities in a thickness of the casing, extending in parallel to one another from an inner face of the casing along a circumference thereof, the cavities not being in communication with one another. The cavities, which are elongate and extend along a main direction of orientation between two side walls, are closed upstream and downstream by upstream and downstream faces respectively, and an upstream border and a downstream border are formed at the intersections between same and the inner face of the casing. The upstream border
(Continued)

of the cavities takes a form of a wavy line including at least two alternate undulations over a length thereof between the side walls.

9 Claims, 3 Drawing Sheets

(51) Int. Cl.

| | |
|---|---|
| ***F04D 29/16*** | (2006.01) |
| ***F04D 29/52*** | (2006.01) |
| ***F04D 29/68*** | (2006.01) |
| ***F04D 17/10*** | (2006.01) |
| ***F04D 19/00*** | (2006.01) |
| ***F04D 29/42*** | (2006.01) |

(52) U.S. Cl.
CPC ..... *F04D 27/0207* (2013.01); *F04D 29/164* (2013.01); *F04D 29/4206* (2013.01); *F04D 29/526* (2013.01); *F04D 29/541* (2013.01); *F04D 29/685* (2013.01)

(58) Field of Classification Search
CPC .. F04D 29/541; F04D 29/685; F04D 27/0207; F01D 11/08; F01D 5/145; F01D 5/143
See application file for complete search history.

(56) References Cited

U.S. PATENT DOCUMENTS

| | | | | |
|---|---|---|---|---|
| 8,251,648 | B2 * | 8/2012 | Johann | F04D 29/685 415/173.1 |
| 8,845,269 | B2 * | 9/2014 | Agneray | F04D 27/0207 415/220 |
| 8,915,699 | B2 * | 12/2014 | Brignole | F04D 29/526 415/58.5 |
| 2003/0002982 | A1 * | 1/2003 | Irie | F01D 11/08 415/220 |
| 2003/0031559 | A1 | 2/2003 | Irie et al. | |
| 2005/0111968 | A1 * | 5/2005 | Lapworth | F04D 29/526 415/182.1 |
| 2007/0160459 | A1 | 7/2007 | Tudor | |
| 2009/0041576 | A1 | 2/2009 | Guemmer et al. | |
| 2009/0246007 | A1 * | 10/2009 | Johann | F04D 29/685 415/182.1 |
| 2010/0014956 | A1 | 1/2010 | Guemmer | |
| 2010/0034637 | A1 | 2/2010 | Guemmer | |
| 2010/0329852 | A1 * | 12/2010 | Brignole | F04D 29/526 415/159 |
| 2012/0003085 | A1 * | 1/2012 | Agneray | F04D 27/0207 415/199.5 |

FOREIGN PATENT DOCUMENTS

| | | |
|---|---|---|
| EP | 2 143 956 A2 | 1/2010 |
| EP | 2 151 582 A2 | 2/2010 |

* cited by examiner

COMPRESSOR CASING COMPRISING CAVITIES HAVING AN OPTIMISED UPSTREAM SHAPE

The field of the present invention is that of propulsion and more particularly that of axial or axi-centrifugal compressors for a propulsion unit (turbojet engine or turboprop engine, referred to as turbine engines in the remainder of the description) and more specifically to highly loaded high-pressure compressors.

Aeronautical turbine engines mainly consist of one or more compressors, in which the air sucked through the air inlet is compressed, by a combustion chamber in which the injected fuel is burnt, and then by a turbine in which the burnt gases are expanded in order to drive the compressor or compressors and finally by an ejection device. Aeronautical compressors consist of fins, or blades, that are rotated inside a casing that provides the airtightness of the air duct vis-à-vis the outside of the engine. It is known that the clearance existing between the ends of the movable blades of the compressor and the casing forming the internal wall of the airflow duct degrades the efficiency of the engine of the turbine engine. Furthermore, this clearance may in particular modify and degrade the functioning of the compressor until a "surge" phenomenon appears, which results from the shedding of the airflow from the surface of the blades. Controlling the flow of air at the end of the blades thus constitutes an essential aim for obtaining both good aerodynamic efficiency of the compressor and a sufficient margin against the surge phenomenon.

One approach that has been developed for limiting the impact of this unwanted flow between the end of the blade and the casing consists of hollowing out cavities disposed in the wall of the casing at the blade passage path. These cavities are placed opposite the blade or preferentially offset axially, in the direction of the upstream end of the engine, for the purpose of reinjecting the air flowing in the clearance between the blade and the casing, in the duct upstream of the blade in question. One example of such an embodiment is given in the patent application by the applicant that was published under the number FR 2940374.

The improvement afforded by this embodiment stems merely from an optimisation of the axial position of the cavities and the search for optimisation on other parameters of these cavities must be pursued in order to attempt to improve further the aerodynamic efficiency and/or the surge margin of the existing compressors.

The object of the present invention is therefore to propose a compressor casing provided with cavities, with further improved aerodynamic performance.

To this end, the invention relates to a casing for a turbine engine compressor comprising cavities hollowed out, so as not to communicate with one another, in the thickness of said casing from its internal face and disposed parallel to one another on a circumference of said casing, said cavities having an elongate shape in a principal direction of orientation between two lateral walls and being closed towards the upstream end and towards the downstream end by an upstream face and by a downstream face respectively, the intersections of which with the internal face of the casing form an upstream boundary and a downstream boundary respectively, characterised in that the upstream boundary of these cavities is in the form of an undulating line comprising at least two half-waves over its length lying between said lateral walls.

The presence of an undulating line promotes the mixture of the air reinjected with the main air and thus improves the efficiency and/or the surge margin of the relevant stage of the compressor using said casing.

Advantageously said lateral walls converge towards each other while being directed from downstream to upstream. This configuration accelerates the air that flows between the blade and the casing and improves the reinjection thereof into the duct, which, there also, results in an improvement in the efficiency and/or the surge margin of the relevant stage.

In a particular embodiment the undulating line is a broken zigzag line, consisting of segments forming with one another alternately projecting angles and re-entrant angles.

Preferentially the upstream face of said cavities is formed by a succession of teeth extending, radially, between the upstream boundary and the bottom of the cavity and, axially, alternately towards the upstream end and towards the downstream end of said cavity.

Advantageously, the downstream face has a convex shape. This facilitates the suction of the air downstream of the cavity.

In a particular embodiment the cavities are distributed evenly over the circumference of the casing.

In an alternative embodiment the cavities are distributed unevenly over the circumference of the casing.

The invention also relates to a compressor for a turbine engine comprising a casing as described above and a turbine engine comprising such a compressor.

The invention will be better understood, and other aims, details, features and advantages thereof will emerge more clearly during the following detailed explanatory description of an embodiment of the invention given by way of purely illustrative and non-limitative example, with reference to the accompanying schematic drawings.

Figure 1:
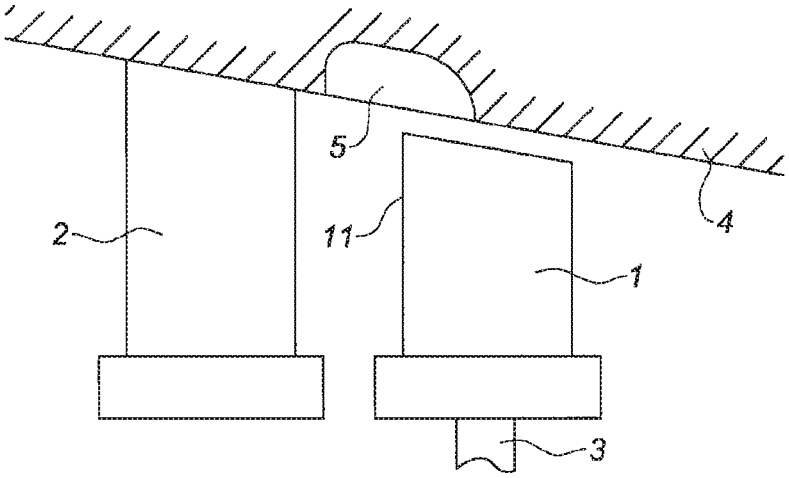
FIG. 1 is a schematic cross section of a compressor stage, the casing of which has a cavity for recirculating the air flowing between the blade and the casing.

Referring to FIG. 1, a compressor stage can be seen comprising a stator vane, or fixed vane 2, positioned upstream of a rotor blade, or movable blade 1, attached to a disc 3 (or directly secured to this disc according to a technology known as single-piece vaned disc technology). The fixed vanes are held in place by fixing on a compressor casing 4, which surrounds the movable blades 1, leaving a predefined clearance with them.

The casing 4 is hollowed out, from its internal face, with multiple cavities 5, not communicating with one another, which are evenly disposed on its circumference, opposite the passage path of the movable blades 1. These cavities are, roughly, in the form of a right-angled parallelepiped that is sunk radially into the casing and has, in cross section in an axial plane, the form of a rectangle with rounded corners. Their shape, in cross section in a plane tangent to the circumference of the casing 4, is, for its part, substantially that of an elongate rectangle extending along two large sides and comprising, upstream and downstream, two small sides forming so-called upstream 7 and downstream 6 boundaries. It should be noted that, in the prior art, these two boundaries are conventionally segments of a straight line.

As can be seen in FIG. 1, the cavities 5 are offset towards the upstream end of the engine, with respect to the leading edge 11 of the movable blade 1. The length by which the upstream side 7 of the cavity 5 projects with respect to the leading edge of the blades is however limited by the space existing between the movable-blade wheel 1 and the fixed-vane wheel 2. Because of the embedding of these cavities, the stray air is sucked at a certain percentage of the chord of the movable blade and reinjected into the duct upstream of the blade. This configuration allows recirculation of the air that passes in the clearance between the blade 1 and the casing 4; this clearance may in fact be the site of violent turbulences that would disturb the configuration of the flow between the various stages and which therefore could cause degradation of the performance of the compressor or, in the extreme, cause a so-called "surge" or "shedding" phenomenon. Such a phenomenon is characterised by an instantaneous drop in the compression ratio and a transient reversal of the air flow passing through the compressor, which then emerges through the upstream end of the compressor.

Figure 2:
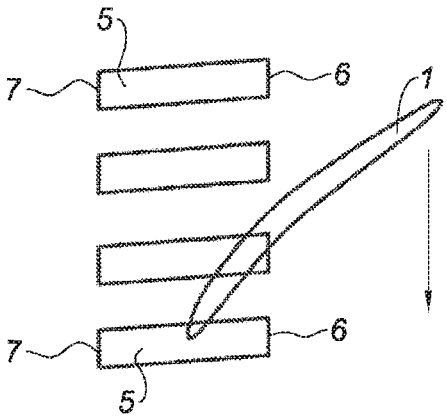
Fig. 2 Prior Art
FIG. 2 is a schematic plan view of a rotor blade and a casing according to the prior art.
Figure 3:
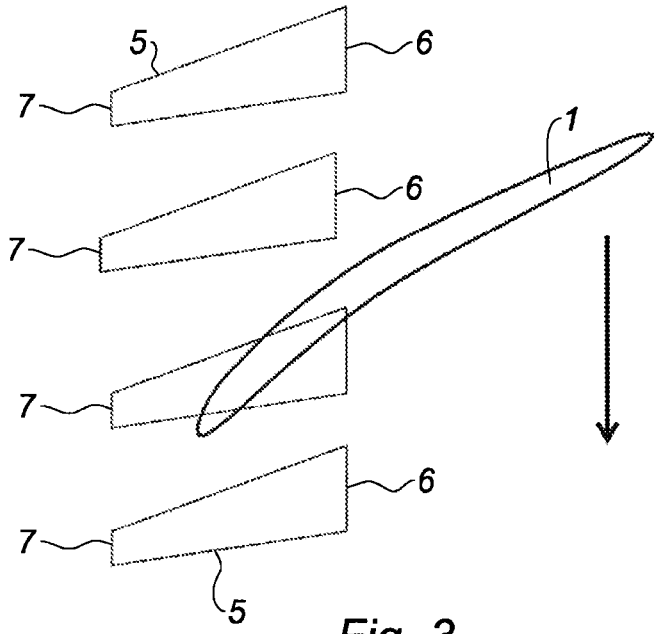
FIG. 3 is a schematic plan view of a rotor blade and a casing according to an embodiment of the invention.

Referring now to FIGS. 2 and 3, the circumferential position of a series of cavities 5 aligned along the casing 4 can be seen, according to the prior art and according to the invention respectively. The number of cavities is very much greater than the number of blades 1 constituting the movable wheel of the compressor stage. This number is in practice between 2 and 4 times the number of movable blades 1. The circumferential distribution of the cavities, as shown in the figures, is a uniform arrangement; it has moreover already been proposed to make this arrangement irregular in order to break up the aerodynamic excitation on the bladings that could be caused by these cavities, in particular at the ends of each of the two half-shells that constitute the casing.

In FIG. 2, which is the prior art, the cut-out formed by the cavities 5 at their intersection with the internal face of the casing 4 has a substantially rectangular shape with the two large, substantially parallel sides. On the other hand, in FIG. 3, which shows an embodiment of the invention, the cut-out of the cavities has a trapezoidal shape, with two small sides at the upstream end and at the downstream end that are substantially parallel and two large sides that are convergent towards the upstream end, so that the downstream boundary 6 has a greater length than that of the upstream boundary 7.

Figure 4:
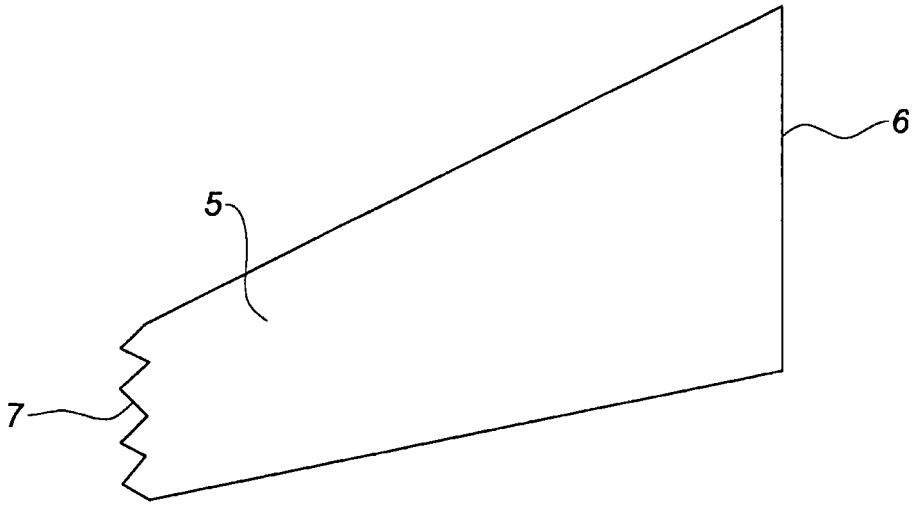
FIG. 4 is a schematic view of the cut-out of a cavity in a casing according to the invention.

FIG. 4 shows in detail the shape of the cut-out of a cavity 5 in a casing 4, according to the invention, at the internal face of the casing 4. Whereas the downstream small side, that is to say the downstream boundary 6, is, as in the prior art, rectilinear, the upstream small side, that is to say the upstream boundary 7, is not, but is in the form of chevrons that develop on either side of the circumferential line connecting the upstream boundaries of the various cavities 5.

Figure 5:
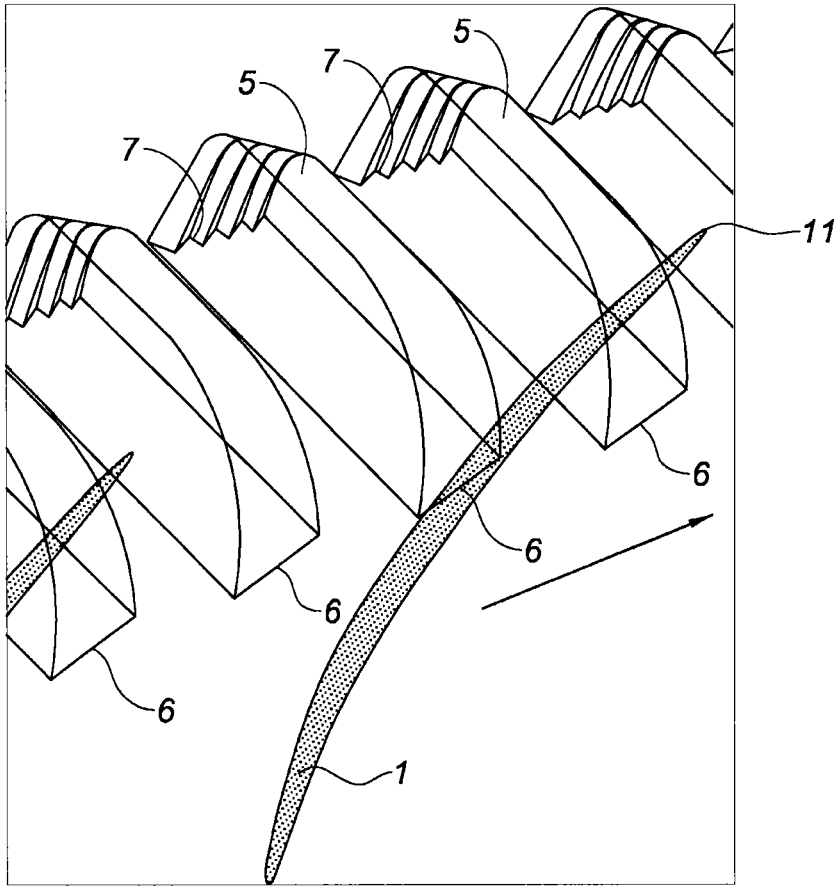
FIG. 5 is a perspective view of the cavities cut out in a casing according to the invention.

FIG. 5 shows, in perspective and in relief, the form of the cavities 5 and their relative position with respect to a movable-blade wheel 1, in the case of a casing 4 according to the invention. The front face of the parallelepiped forming the cavity 5 is undulating in the form of chevrons that extend all the way along the front face of the cavity, arising in the bottom of the cavity and ending in a zigzag line at the internal face of the cavity 4 and the upstream boundary 7.

The contribution of the invention will now be explained by stating first of all the operating principle of the treatments of casings by embedding cavities 5 in the thickness thereof. Two aerodynamic effects are combined: firstly, the suction of the air at the leading edge at the top of the rotor makes it possible to counter the development of the clearance vortex between the rotor and the casing, which gains in efficiency and in the stability limit; secondly, the reinjection of air upstream of the movable wheel makes it possible, through a re-energisation of the limit layer, to gain in the stability limit, and therefore in the surge margin.

It is considered in general that it is necessary to take into account three particular parameters for obtaining the best result with a casing treatment by incorporation of cavities 5. The first concerns the axial position of the downstream end of the cavity, which defines the point where the air is sucked in, the second, the axial position of the upstream end of the cavity, which defines the point where the air is reinjected, and the third, the volume of the cavity, which determines the quantity of air taken off and reinjected, and therefore the efficacy of the casing treatment. However, it is also necessary to take into account a point that directly influences the efficacy of the casing treatment and which concerns the quality of the reinjection of the air upstream of the movable wheel. In particular, firstly, the reinjection speed must be as high as possible in order to obtain the most improvement in the surge margin, and, secondly, the air reintroduced into the duct must be mixed as well as possible with the main flow, failing which there is a risk of causing losses of efficiency.

To deal with these two points, the invention proposes, first of all, to have cavities 5 of which the width is variable and which narrow laterally from downstream to upstream. Maintaining a large width for the cavity towards the downstream end is important in order to suck in the recirculation air under good conditions and to prevent the appearance of a clearance vortex; and the reduction in size of the cavity towards the upstream end increases the speed of the air that will be reinjected into the duct. Next, the chevron arrangement improves the mixing of the reinjected air with the main air, in the same way as chevrons on the nozzle of a turbine engine improve the mixing between the hot air discharged from the primary flow and the cold air discharged from the secondary flow.

With these arrangements made on the cavities 5 of a compressor casing 4, the efficacy of suction of the clearance vortex is improved and thus, in addition to an increase in the surge margin, a slight improvement in the efficiency of the compressor stage is obtained.

The invention claimed is:

1. A casing for a turbine engine compressor comprising: cavities hollowed out, so as not to communicate with one another, in a thickness of the casing from its internal face and disposed parallel to one another on a circumference of the casing, the cavities having an elongate form in a principal orientation direction between two lateral walls and being closed towards an upstream end and towards a downstream end by an upstream face and by a downstream face respectively, intersections of which with the internal face of the casing form an upstream boundary and a downstream boundary respectively, wherein the upstream boundary of these cavities is in a form of an undulating line comprising at least two half-waves on its length lying between the lateral walls.

2. A casing for a compressor according to claim 1, wherein the lateral walls converge towards each other while being directed from downstream to upstream.

3. A casing for a compressor according to claim 1, wherein the undulating line is a broken zigzag line, of segments forming with one another alternately projecting angles and re-entrant angles.

4. A casing for a compressor according to claim 1, wherein the upstream face of the cavities is formed by a succession of teeth extending, radially, between the upstream boundary and a bottom of the cavity and, axially, alternately towards the upstream end and towards the downstream end of the cavity.

5. A casing for a compressor according to claim 1, wherein the downstream face has a convex shape.

6. A casing for a compressor according to claim 1, wherein the cavities are distributed evenly over a circumference of the casing.

7. A casing for a compressor according to claim 1, wherein the cavities are distributed unevenly over a circumference of the casing.

8. A compressor for a turbine engine comprising a casing according to claim 1.

9. A turbine engine comprising a compressor according to claim 8.

* * * * *